US008348390B2

(12) United States Patent
Law et al.

(10) Patent No.: US 8,348,390 B2
(45) Date of Patent: Jan. 8, 2013

(54) ENHANCING SUPEROLEOPHOBICITY AND REDUCING ADHESION THROUGH MULTI-SCALE ROUGHNESS BY ALD/CVD TECHNIQUE IN INKJET APPLICATION

(75) Inventors: Kock-Yee Law, Penfield, NY (US); Hong Zhao, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/110,216

(22) Filed: May 18, 2011

(65) Prior Publication Data

US 2012/0293586 A1 Nov. 22, 2012

(51) Int. Cl.
*B41J 2/04* (2006.01)

(52) U.S. Cl. ..... 347/54; 347/56; 347/45; 347/44

(58) Field of Classification Search ..... 347/54, 347/56, 45, 44
See application file for complete search history.

(56) References Cited

U.S. PATENT DOCUMENTS 6,648,470 B2 * 11/2003 Korem ..... 347/106
2011/0157276 A1 * 6/2011 Zhao et al. ..... 347/44
2011/0157277 A1 * 6/2011 Zhao et al. ..... 347/44
2011/0157278 A1 * 6/2011 Gulvin et al. ..... 347/45
2011/0279516 A1 * 11/2011 Hu et al. ..... 347/21

OTHER PUBLICATIONS

Chinn, Jeff, Fred Helmrich, Rolf Guenther, Mark Wiltse, Kendall Hurst and Robert W. Ashurst. Durable Super-Hydrophobic Nano-Composite Films. NSTI-Nanotech 2010, vol. 1, pp. 612-615.

Zhao, Hong, Kock-Yee Law and Varun Sambhy. Fabrication, Surface Properties, and Origin of Superoleophobicity for a Model Textured Surface. Langmuir 2011 (27), pp. 5927-5935.

Patankar, Neelesh A. Mimicking the Lotus Effect: Influence of Double Roughness Structures and Slender Pillars. Langmuir 2004, 20, pp. 8209-8213.

* cited by examiner

*Primary Examiner* — Manish S Shah
(74) *Attorney, Agent, or Firm* — MH2 Technology Law Group LLP

(57) ABSTRACT

Various embodiments provide a device having a multi-scale superoleophobic surface and methods for forming and using the device, wherein a particulate composite layer including metal-containing particulates is formed on a textured micron-/sub-micron surface of a semiconductor layer to provide device with multi-scale rough surface.

14 Claims, 4 Drawing Sheets

ENHANCING SUPEROLEOPHOBICITY AND REDUCING ADHESION THROUGH MULTI-SCALE ROUGHNESS BY ALD/CVD TECHNIQUE IN INKJET APPLICATION

BACKGROUND

Fluid ink jet systems typically include one or more printheads having a plurality of ink jets from which drops of fluid are ejected towards a recording medium. The ink jets of a printhead receive ink from an ink supply chamber or manifold in the printhead which, in turn, receives ink from a source, such as a melted ink reservoir or an ink cartridge. Each ink jet includes a channel having one end in fluid communication with the ink supply manifold. The other end of the ink channel has an orifice or nozzle for ejecting drops of ink. The nozzles of the ink jets may be formed in an aperture or nozzle plate that has openings corresponding to the nozzles of the ink jets. During operation, drop ejecting signals activate actuators in the ink jets to expel drops of fluid from the ink jet nozzles onto the recording medium. By selectively activating the actuators of the ink jets to eject drops as the recording medium and/or printhead assembly are moved relative to one another, the deposited drops can be precisely patterned to form particular text and graphic images on the recording medium.

One difficulty faced by fluid ink jet systems is wetting, drooling or flooding of inks onto the printhead front face. Such contamination of the printhead front face can cause or contribute to blocking of the ink jet nozzles and channels, which alone or in combination with the wetted, contaminated front face, can cause or contribute to non-firing or missing drops, undersized or otherwise wrong-sized drops, satellites, or misdirected drops on the recording medium and thus result in degraded print quality.

Current printhead front face coatings are typically sputtered polytetrafluoroethylene coatings. When the printhead is tilted, the UV gel ink at a typical jetting temperature between 75-95° C. and the solid ink at a typical jetting temperature of about 105° C. do not readily slide on the printhead front face surface. Rather, these inks adhere and flow along the printhead front face and leave an ink film or residue on the printhead which can interfere with jetting. For this reason, the front faces of UV and solid ink printheads are prone to be contaminated by UV and solid inks. In some cases, the contaminated printhead can be refreshed or cleaned with a maintenance unit. However, such an approach introduces, system complexity, hardware cost, and sometimes reliability issues.

There remains a need for materials and methods for preparing devices having superoleophobic characteristics alone or in combination with superhydrophobic characteristics. Further, while currently available coatings for ink jet printhead front faces are suitable for their intended purposes, a need remains for an improved printhead front face design that reduces or eliminates wetting, drooling, flooding, or contamination of UV or solid ink over the printhead front face; that is ink phobic or oleophobic, and robust to withstand maintenance procedures such as wiping of the printhead front face; and/or that is easily cleaned or self-cleaning, thereby eliminating hardware complexity, such as the need for a maintenance unit, reducing run cost and improving system reliability.

SUMMARY

According to various embodiments, the present teachings include a superoleophobic device. The superoleophobic device can include a semiconductor layer disposed over a substrate. The semiconductor layer can have a textured surface formed by one or more of a pillar structure, a groove structure, and a combination thereof. The superoleophobic device can also include a conformal particulate composite layer disposed on the textured surface of the semiconductor layer. A surface of the conformal particulate composite layer can have a plurality of metal-containing particulates. The superoleophobic device can further include a conformal oleophobic coating disposed on the conformal particulate composite layer to provide the device with a multi-scale superoleophobic surface.

According to various embodiments, the present teachings also include a method of forming a superoleophobic device. The superoleophobic device can be formed to include a semiconductor layer having a textured surface formed by one or more of a pillar structure, a groove structure, and a combination thereof. A particulate composite layer can then be conformally formed on the textured surface of the semiconductor layer such that a surface of the conformal particulate composite layer can include a plurality of metal-containing particulates. The particulate composite layer can be chemically modified by conformally disposing an oleophobic coating thereon to provide the device with a multi-scale superoleophobic surface.

According to various embodiments, the present teachings further include a method of forming a superoleophobic device, by providing a semiconductor layer on a flexible substrate. A textured surface can be created in the semiconductor layer using photolithography. The textured, surface can be formed by one or more of a pillar structure, a groove structure, and a combination thereof, while each of the pillar structure and the groove structure can have one or more of a wavy side wall, an overhang structure, and a combination thereof. A conformal particulate composite layer can then be formed on the textured surface of the semiconductor layer using an atomic layer deposition (ALD) process such that a surface of the conformal particulate composite layer can include a plurality of metal-containing particulates to provide the device with a multi-scale surface. The particulate composite layer can be chemically modified by conformally disposing an oleophobic coating thereon to provide the device with a multi-scale superoleophobic surface.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated, in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Various embodiments provide a device having a multi-scale superoleophobic surface and methods for forming and using the device. In one embodiment, the exemplary device can include a semiconductor layer disposed over a substrate. The semiconductor layer can include a textured surface formed by groove structures and/or pillar structures, providing micron- and/or submicron-scale levels for the device surface. Overlaying the semiconductor layer, there can be a conformal particulate composite layer having a surface with a plurality of metal-containing particulates, providing an additional scale level, e.g., in a nano-scale, for the device surface. The device can then have a "multi-scale surface", e.g., a surface that includes a scale level that varies from micro-scale to sub-micro-scale to nano-scale. Overlaying the surface having metal-containing particulates, there can be a conformal oleophobic coating to provide the device with a "multi-scale superoleophobic surface."

FIGS. 1A-1C and FIGS. 2A-2C depict exemplary devices at various stages of their fabrication, in accordance with various embodiments of the present teachings. As used herein, the term "a device having multi-scale superoleophobic surface" is also, referred to herein as "a multi-scale superoleophobic device".

Figure 1B:
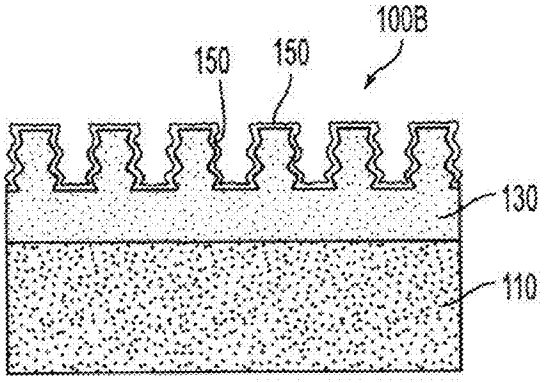
FIGS. 1A-1C depict an exemplary device having a multi-scale superoleophobic surface at various stages of the fabrication in accordance with various embodiments of the present teachings.
Figure 1A:
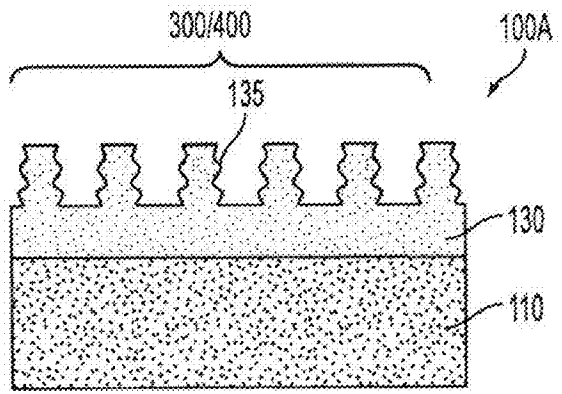

In FIG. 1A, the device 100A can include a semiconductor layer 130 disposed or formed over a substrate 110. In embodiments, the substrate 110 can be, e.g., a flexible substrate. Any suitable material can be selected for the flexible substrate herein. The flexible substrate can be a plastid film or a metallic film. In specific embodiments, the flexible substrate can be selected from polyimide film, polyethylene naphthalate film, polyethylene terephthalate film, polyethersulfone, polyetherimide, stainless steel, aluminum, nickel, copper, and the like, or a combination thereof, although not limited. The flexible substrate can be any suitable thickness. In embodiments, the substrate can have a thickness of from about 5 micrometers to about 100 micrometers, or from about 10 micrometers to about 50 micrometers.

The semiconductor layer 130 can be, e.g., a silicon layer of amorphous silicon. The semiconductor layer 130 can be prepared by depositing a thin layer of amorphous silicon onto large areas of the substrate 110. The thin layer of silicon can have any suitable thickness. In embodiments, the silicon layer can be deposited onto the substrate 110 at a thickness of from about 500 nm to about 5 μm, or from about 1 μm to about 5 μm, such as about 3 μm. The layer of silicon can be formed by, e.g., sputtering, chemical vapor deposition, very high frequency plasma-enhanced chemical vapor deposition, microwave plasma-enhanced chemical vapor deposition, plasma-enhanced chemical vapor deposition, use of ultrasonic nozzles in an in-line process, among others.

Figure 3:
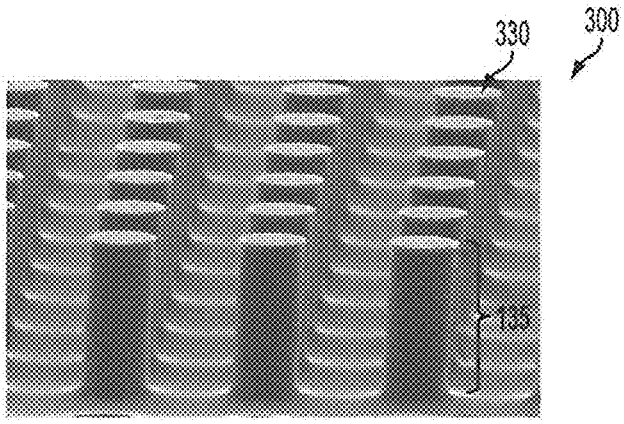
FIG. 3 depicts a perspective view of an exemplary semiconductor layer having a textured surface formed of pillar arrays in accordance with various embodiments of the present teachings.
Figure 4:
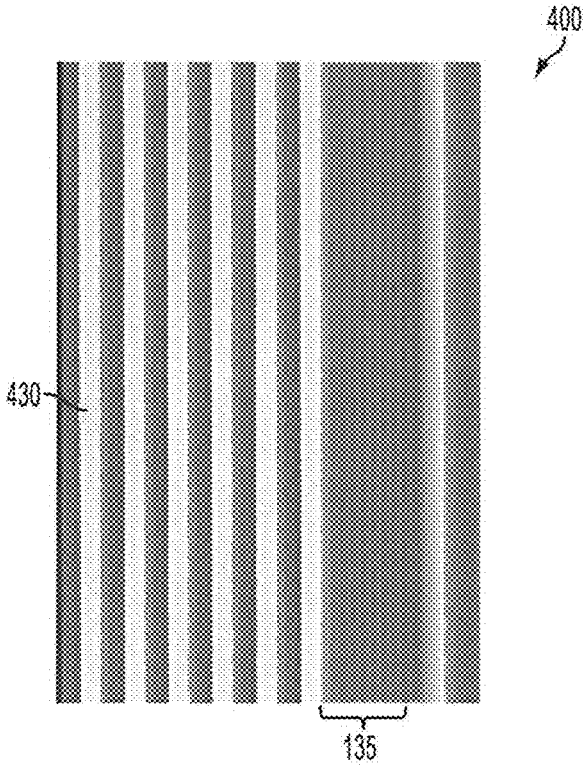
FIG. 4 depicts a perspective view of an exemplary semiconductor layer having a textured surface formed of groove structures in accordance with various embodiments of the present teachings.

The semiconductor layer 130 can have a textured surface including pillar structure(s), e.g., arranged as pillar arrays 300 as shown in FIG. 3 and/or groove structures 400 as shown in FIG. 4. Each pillar structure 330 in FIG. 3 and/or each groove structure 430 in FIG. 4 can further include, for example, wavy side walls 135 (also see FIG. 1A).

The pillar arrays and/or groove structures with wavy side walls as shown in FIG. 1A and FIGS. 3-4 can be created, e.g., on or in a semiconductor layer using photolithography techniques, e.g., by various suitable patterning and etching methods as known to one of ordinary skill in the art. In an exemplary embodiment to form the device 100A, a photoresist layer can be formed on a silicon layer deposited on a flexible substrate. The photoresist layer can then be exposed, developed, and patterned, and can be used as an etching mask for the etching process (e.g., a wet etching, a deep reactive ion etching, or a plasma etching) of the underlying silicon. Each etching cycle can correspond to one wave of a plurality of waves from the desired wavy side walls 135.

Figure 2B:
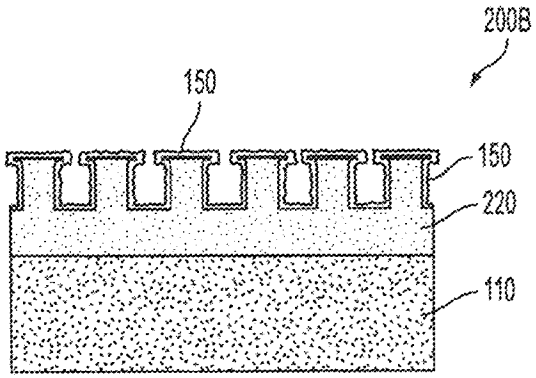
FIGS. 2A-2C depict another exemplary device having a multi-scale superoleophobic surface at various stages of the fabrication in accordance with various embodiments of the present teachings.
Figure 2A:
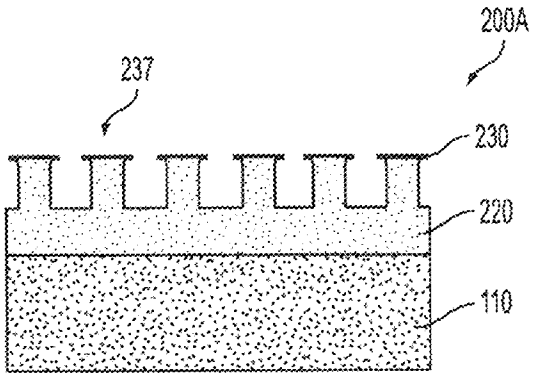

In embodiments, instead of having wavy side walls as shown in FIG. 1A, each pillar structure in pillar arrays and/or each groove structure in the plurality of groove structures can include, for example, one or more overhang structures as shown in FIG. 2A.

For example, pillar arrays and/or groove structures each having overhang structures 237 can be formed by a semiconductor layer 230 (e.g., a silicon oxide layer). The semiconductor layer 230 can be formed over a layer 220 such as a second semiconductor layer of silicon. In one embodiment, the layer 230 over the layer 220 can be "T"-shaped. The layer 220 can be formed over a substrate 110, which can be the same or different from the substrate 110 in FIG. 1A.

In an exemplary embodiment, the device 200A in FIG. 2A can be formed by first providing a flexible substrate. A silicon layer can then be deposited on the flexible substrate and then cleaned. An exemplary $SiO_2$ thin film can be deposited on the cleaned silicon layer, for example, via sputtering or plasma enhanced chemical vapor deposition. This can be followed by steps of, e.g., applying a photo resist material to the silicon oxide coated silicon layer on the flexible substrate, exposing and developing the photo resist material to define a textured pattern in the $SiO_2$ layer including a pillar structure and/or a groove structure using, e.g., a fluorine based ($SF_6/O_2$) reactive ion etching process, followed by hot stripping, to create the overhang structures 237.

Referring back to FIG. 1A and FIG. 2A, the textured surface of the devices 100A and/or 200A can be formed by pillar structures and/or groove structures in micron-scale, while each pillar structure and/or groove structure can have structures of wavy sidewalls and/or overhang structures in sub-micron-scale.

For example, each pillar structure/groove structure can have a height ranging from about 0.3 micrometers to about 4 micrometers, or from about 0.5 micrometers to about 3 micrometers, or from about 1 micrometer to about 2.5 micrometer.

Each pillar structure/groove structure having wavy sidewalls can have an average, width or diameter ranging from about 1 micrometer to about 20 micrometers, or from about 2 micrometers to about 15 micrometers, or from about 2 micrometers to about 5 micrometers. Each wave or the wavy sidewalls can be from about 100 nanometers to about 1,000 nanometers, such as about 250 nanometers.

Each overhang structure can have, e.g., a T-shaped structure, including a top structure having a top width or diameter greater than a bottom structure, and a top thickness/height lower than the bottom structure, where the top width or diameter ranging from about 1 micrometer to about 20 micrometers, or from about 2 micrometers to about 15 micrometers, or from about 2 micrometers to about 5 micrometers, and the bottom width/diameter structure can be from about 0.5 micrometer to about 15 micrometers, or from about 1 micrometer to about 12 micrometers, or from about 1.5 micrometers to about 4 micrometers.

In embodiments, the pillar arrays having wavy sidewalls and/or overhang structures; and/or groove structures having wavy sidewalls and/or overhang structures to form the textured surface can have a solid area coverage of from about 0.5% to about 40%, or from about 1% to about 30%, or from about 4% to about 20%, over the entire surface area of the device 100A and/or 200A. In embodiments, the dimensions, shapes, and/or the solid area coverage of the pillar arrays and/or groove structures are not limited. For example, the pillar and groove structures can have a cross-sectional shape including, but not limited to, a round, elliptical, square, rectangular, triangle, or star-shape.

A particulate composite layer 150 as respectively shown in FIG. 1B and FIG. 2B, can then be conformally disposed on the entire surface of the textured surface of the devices 100A and/or 200A. The surface of the conformal particulate composite layer 150 can include a plurality of metal-containing particulate that are in nano-scale, having at least one dimension ranging from about 1 nanometer to about 200 nanometers, or from about 5 nanometers to about 150 nanometers, or from about 10 nanometers to about 100 nanometers, to further control the surface morphology of the formed device.

The plurality of metal-containing particulates can be formed of, for example, $Al_2O_3$, $TiO_2$, $SiO_2$, SiC, TiC, $Fe_2O_3$, $SnO_2$, ZnO, $HfO_2$, TiN, TaN, $GeO_2$, WN, NbN, Ru, Ir, Pt, ZnS, and/or a combination thereof. In embodiments, the conformal particulate composite layer 150 can have a layer thickness ranging from about 1 nanometer to about 200 nanometers, or from about 5 nanometers to about 150 nanometers, or from about 10 to about 100 nanometers. In some cases, in addition to the metal-containing particulates, the conformal particulate composite layer 150 can include, such as, for example, silane oxides, alkyl Aluminum oxides, e.g., $Al—O—Al(CH_3)_2$ or AlOH, $SiO_x—(CH_2)_2—SiO_x$, zinc oxides, or, tin oxides and, the like to ensure good adhesion between the particulate layer and the substrate.

Any suitable methods and processes can be used to form the particulate composite layer 150 including metal-containing particles. For example, the particulate composite layer 150 can be conformally formed over the entire texture surface of 100A and 200A by an atomic layer deposition (ALD), a chemical vapor deposition (CVD), or other suitable processes, and/or combinations thereof. In an exemplary embodiment, the particulate composite layer 150 can include a plurality of $Al_2O_3$ particulates and silane oxides, for example, prepared by a hybrid process including ALD and CVD.

Figure 1C:
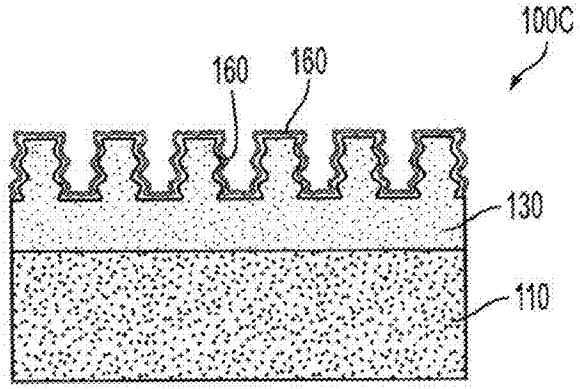
Figure 2C:
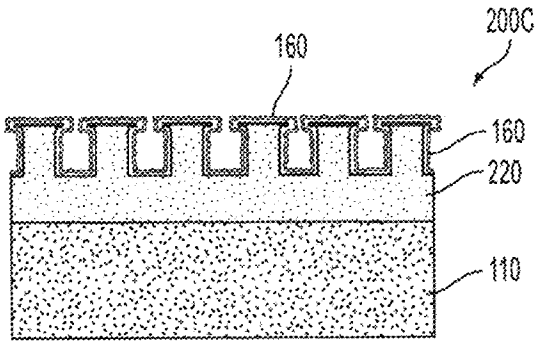

In FIG. 1C and FIG. 2C, the particulate composite layer 150 can then be chemically modified to further provide desired surface properties, such as to provide or enhance the oleophobic quality of the multi-scaled surface of the device 100B and 200B. Any suitable chemical treatment of the particulate composite layer 150 can be used. For example, a self-assembled layer 160 including, e.g., perfluorinated alkyl chain, can be deposited on the particulate composite layer 150.

A variety of technologies, such as the molecular vapor deposition (MVD) technique, the CVD technique, or the solution coating technique can be used to deposit the self-assembled layer of perfluorinated alkyl chains onto the surface of the particulate composite layer 150. In embodiments, chemically modifying the textured, substrate can include chemical modification by conformally self-assembling, a fluorosilane coating onto the multi-scale surface shown in FIGS. 1B and/or 2B via a MVD technique, a CVD technique, or a solution self assembly technique. In a specific embodiment, the chemical modification can include disposing layers assembled by tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, or a combination thereof, and the like, using the MVD technique or the solution coating technique.

In this manner, exemplary devices can be formed as shown in FIG. 1C and FIG. 2C to provide a multi-scale surface that is superoleophobic. In embodiments, the exemplary devices can have a surface that is both superoleophobic and superhydrophobic.

A droplet of hydrocarbon-based liquid, for example, hexadecane or ink, can form a super high contact angle with the multi-scale superoleophobic surface of the devices 100C and 200C, such as a contact angle of about 100° or greater, e.g., ranging from about 100° to about 175°, or from about 120° to about 170°. The droplet of a hydrocarbon-based liquid can also form a sliding angle with the disclosed multi-scale superoleophobic surface of from about 1° to about 30°, or from about 1° to about 25°, or from about 1° to about 20°.

In some cases, a droplet of water can form a high contact angle with the disclosed multi-scale superoleophobic surface, such as a contact angle of about 120° or greater, e.g., ranging from about 120° to about 175°, or from about 130° to about 165°. The droplet of water can also form a sliding angle with the multi-scale superoleophobic surface, such as a sliding angle of from about 1° to about 30°, or from about 1° to about 25°, or from about 1° to about 20°.

In embodiments, when the multi-scale superoleophobic devices are incorporated with an ink jet printhead front face, jetted drops of ultra-violet (UV) gel ink (also referred to herein as "UV ink") and/or jetted drops of solid ink can exhibit low adhesion to the multi-scale superoleophobic surface. As used herein, the term "ink drops" refers to the jetted drops of ultra-violet (UV) gel ink and/or jetted drops of solid ink.

The multi-scale superoleophobic devices can therefore be used as an anti-wetting easy clean, self clean surface device for ink jet printhead front face due to the low adhesion between ink drops and the surface. For example, the multi-scale superoleophobic devices can be bonded to a front face such as a stainless steel aperture plate of an ink-jet printhead.

Figure 5:
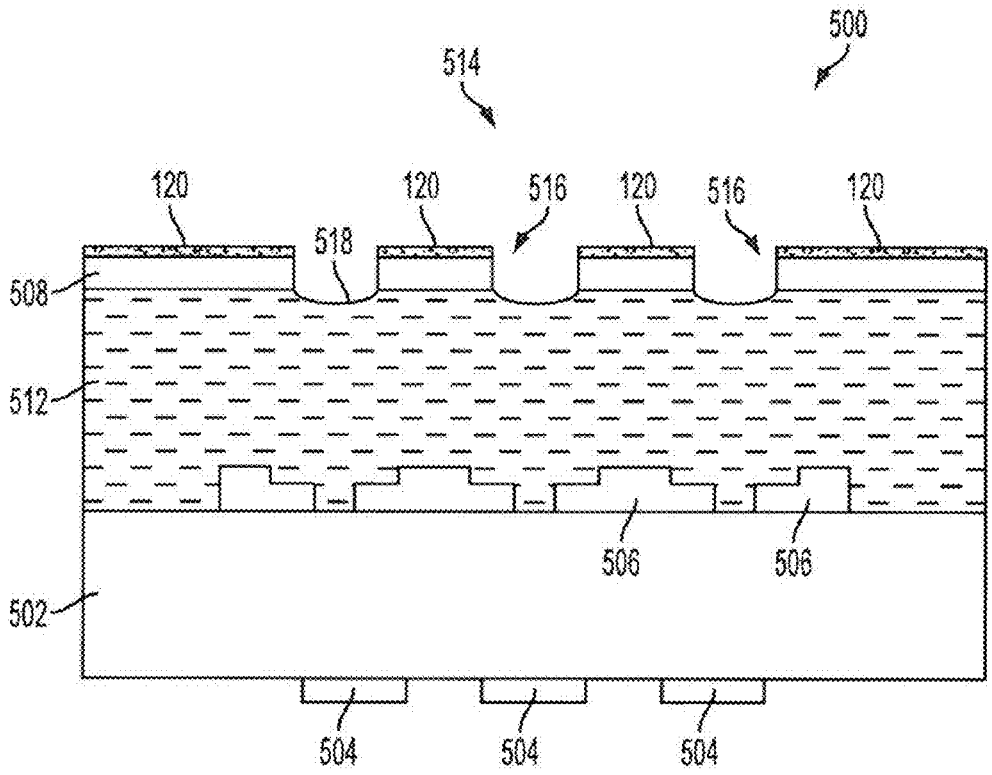
FIG. 5 depicts an exemplary printhead including a multi-scale superoleophobic device in accordance with various embodiments of the present teachings.

FIG. 5 depicts an exemplary printhead 500 including multi-scale superoleophobic devices in accordance with various embodiments of the present teachings. As shown, the exemplary printhead 500 can include a base substrate 502 with transducers 504 on one surface and acoustic lenses 506 on an opposite surface. Spaced from the base substrate 502 can be a liquid level control plate 508. A multi-scale superoleophobic device in accordance with various embodiments can be disposed along the plate 508. The base substrate 502 and the liquid level control plate 508 can define a channel which holds a flowing liquid 512. The liquid level control plate 508 can contain an array 514 of apertures 516. The transducers 504, acoustic lenses 506, and apertures 516 can be all axially aligned such that an acoustic wave produced by a single transducer 504 can be focused by its aligned acoustics 506 at approximately a free surface 518 of the liquid 512 in its aligned aperture 516. When sufficient power is obtained, a droplet can be emitted from surface 518.

The exemplary printhead 500 can prevent ink contamination because ink droplets can roll off the printhead front face leaving no residue behind due to the multi-scale superoleophobic surface. The multi-scale superoleophobic surface can provide the ink jet printhead aperture plates, with high drool pressure due to its superoleophobicity. Generally, the greater the ink contact angle the better (higher) the drool pressure. Drool pressure relates to the ability of the aperture plate to avoid ink weeping out of the nozzle opening when the pressure of the ink tank (reservoir) increases. That is, the multi scale superoleophobic device described herein can provide low adhesion and high contact angle for ink drops of ultra-violet curable gel ink and/or solid ink, which further provides the benefit of improved drool pressure or reduced (or eliminated) weeping of ink out of the nozzle.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A superoleophobic device comprising:

a substrate;

a semiconductor layer comprising a textured surface and disposed over the substrate, wherein the textured surface is formed by one or more of a pillar structure, a groove structure, and a combination thereof;

a conformal particulate composite layer disposed on the textured surface of the semiconductor layer; wherein a surface of the conformal particulate composite layer comprises a plurality of metal-containing particulates; and a conformal oleophobic coating disposed on the conformal particulate composite layer to provide the device with a multi-scale superoleophobic surface.

2. The device of claim 1, wherein each of the plurality of metal-containing particulates is selected from the group consisting of $Al_2O_3$, $TiO_2$, $SnO_2$, ZnO, $SiO_2$, SiC, TiC, $Fe_2O_3$, $HfO_2$, TiN, TaN, WN, NbN, Ru, Ir, Pt, ZnS, $GeO_2$, and combinations thereof.

3. The device of claim 1, wherein the plurality of metal-containing particulates has at least one dimension ranging from about 1 nanometer to about 100 nanometers.

4. The device of claim 1, wherein the conformal particulate composite layer has a layer thickness ranging from about 1 nanometer to about 200 nanometers.

5. The device of claim 1, wherein the conformal particulate composite layer further comprises silane oxides, alkyl aluminum oxides, zinc oxides or tin oxides.

6. The device of claim 1, wherein hexadecane has a contact angle with the multi-scale superoleophobic surface of greater than about 120°.

7. The device of claim 1, wherein hexadecane has a sliding angle with the multi-scale superoleophobic surface of less than about 30°.

8. The device of claim 1, wherein a precursor for the conformal oleophobic coating is tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane; heptadecafluoro-1,1,2,2-tetrahydrooctyltriethoxysilane, or a combination thereof.

9. The device of claim 1, wherein each of the pillar structure and the groove structure has a height ranging from about 0.3 micrometers to about 4 micrometers.

10. The device of claim 1, wherein a solid area coverage of the one or more of the pillar structure, the groove structure, and the combination thereof over the semiconductor layer is from about 0.5% to about 40%.

11. The device of claim 1, wherein each of the pillar structure and the groove structure comprises a wavy side wall, an overhang structure, or a combination thereof, wherein each of the pillar structure and the groove structure has a diameter ranging from about 1 micrometer to about 20 micrometers, wherein the wavy side wall comprises a plurality of waves with each wave having a size from about 100 nanometers to about 1,000 nanometers, and wherein the overhang structure comprises a T-shaped structure comprising a top structure having a top width ranging from about 1 micrometer to about 20 micrometers and a bottom structure having a bottom width ranging from about 0.5 micrometers to about 15 micrometers.

12. The device of claim 1, wherein the substrate is flexible and comprises polyimide film, polyethylene naphthalate film, polyethylene terephthalate film, polyethersulfone film, polyetherimide film, stainless steel film, aluminum film, copper film, or nickel film.

13. An ink jet printhead comprising a front face, wherein the front face comprises the device of claim 1.

14. The ink jet printhead of claim 13, wherein the front face is self cleaning and wherein ink drops of a solid ink or a UV ink have a low sliding angle with a surface of the front face of less than about 30°.

* * * * *